US010156387B2

(12) United States Patent
Kwon et al.

(10) Patent No.: US 10,156,387 B2
(45) Date of Patent: Dec. 18, 2018

(54) OUTDOOR DEVICE FOR AN AIR CONDITIONER

(71) Applicant: LG ELECTRONICS INC., Seoul (KR)

(72) Inventors: Sangyoung Kwon, Seoul (KR); Jaewan Lee, Seoul (KR); Hyunjun Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 426 days.

(21) Appl. No.: 14/929,474

(22) Filed: Nov. 2, 2015

(65) Prior Publication Data

US 2016/0178249 A1 Jun. 23, 2016

(30) Foreign Application Priority Data

Dec. 18, 2014 (KR) ..... 10-2014-0183411
Apr. 22, 2015 (KR) ..... 10-2015-0056578

(51) Int. Cl.
*F25B 13/00* (2006.01)
*F24F 1/14* (2011.01)
(Continued)

(52) U.S. Cl.
CPC ..... *F25B 13/00* (2013.01); *F24F 1/14* (2013.01); *F24F 1/16* (2013.01); *F24F 1/30* (2013.01);
(Continued)

(58) Field of Classification Search
CPC ..... F24F 1/14; F24F 1/16; F24F 1/50; F25B 13/00; F25B 2313/02533; F25B 2313/02541
(Continued)

(56) References Cited

U.S. PATENT DOCUMENTS 2,770,100 A * 11/1956 Raney ..... F24F 3/1405 62/173
3,643,462 A * 2/1972 Eberhart ..... F25B 49/027 62/196.4
(Continued)

FOREIGN PATENT DOCUMENTS

CN 101403541 4/2009
CN 102706046 10/2012
(Continued)

OTHER PUBLICATIONS

Korean Office Action dated May 24, 2016 issued in Application No. 10-2015-0056578.
(Continued)

*Primary Examiner* — Henry Crenshaw
(74) *Attorney, Agent, or Firm* — Ked & Associates LLP

(57) ABSTRACT

An outdoor device for an air conditioner is provided that may include a compressor, a flow switch provided at an outlet-side of the compressor to switch a flow direction of a refrigerant according to a cooling operation or a heating operation, and an outdoor heat exchanger connected to the flow switch. The outdoor heat exchanger may include first to third heat exchangers, each of which may include a refrigerant tube through which the refrigerant may flow, the first to third heat exchangers being connected to each other in parallel during a heating operation and in series during a cooling operation, a first branch that branches the refrigerant into a first distribution tube, which may be directed to the first and second heat exchangers, and a second distribution tube which may be directed to the third heat exchanger, a second branch that branches the refrigerant branched from the first branch into a first branch tube, which may be directed to the first heat exchanger and a second branch tube,
(Continued)

which may be directed to the second heat exchanger, and a first valve provided in the first distribution tube.

18 Claims, 6 Drawing Sheets

(51) Int. Cl.
*F24F 1/16* (2011.01)
*F24F 1/30* (2011.01)
*F24F 1/50* (2011.01)

(52) U.S. Cl.
CPC ..... *F24F 1/50* (2013.01); *F25B 2313/02533* (2013.01); *F25B 2313/02541* (2013.01); *F25B 2400/075* (2013.01); *F25B 2400/13* (2013.01); *F25B 2600/2501* (2013.01); *F25B 2700/1931* (2013.01)

(58) Field of Classification Search
USPC ..... 62/160
See application file for complete search history.

(56) References Cited

U.S. PATENT DOCUMENTS 3,750,415 A * 8/1973 Peuchen ..... B01D 53/265 425/522
3,849,854 A * 11/1974 Mattioli ..... B21D 53/085 228/131
3,898,865 A * 8/1975 Stewart ..... F24F 1/04 62/262
3,908,393 A * 9/1975 Eubank ..... B60H 1/3202 62/305
4,462,463 A * 7/1984 Gorham, Jr. ..... F28D 7/0066 165/140
5,076,354 A * 12/1991 Nishishita ..... F28D 1/05391 165/146
5,765,393 A * 6/1998 Shlak ..... F25B 39/02 165/146
6,308,526 B1 * 10/2001 Esty ..... F24F 13/32 62/277
6,557,372 B1 * 5/2003 Ozawa ..... F25B 6/04 165/144
9,140,474 B2 * 9/2015 Jang ..... F25B 49/02
2003/0213259 A1 * 11/2003 Upton ..... A47F 3/0408 62/246
2004/0163407 A1 * 8/2004 Kim ..... F24F 1/52 62/428
2005/0046423 A1 * 3/2005 Marek ..... G01R 33/34076 324/322
2010/0012054 A1 * 1/2010 Justin ..... F01P 3/18 123/41.1
2010/0084120 A1 * 4/2010 Yin ..... F22B 27/00 165/146
2010/0170270 A1 7/2010 Jang et al.
2011/0139420 A1 * 6/2011 Wang ..... F28F 1/022 165/172
2011/0259551 A1 * 10/2011 Kasai ..... F25B 39/028 165/100
2014/0060789 A1 * 3/2014 Rousseau ..... F01K 23/065 165/166
2014/0318168 A1 10/2014 Morimoto et al.
2015/0362222 A1 * 12/2015 Matsuda ..... F25B 39/028 62/324.1
2016/0033179 A1 * 2/2016 Kim ..... F25B 13/00 62/324.6
2016/0123645 A1 * 5/2016 Kim ..... F25B 49/02 62/115
2017/0097179 A1 * 4/2017 Martin ..... F25B 39/00
2017/0153050 A1 * 6/2017 Nakagawa ..... F25B 47/022

FOREIGN PATENT DOCUMENTS

CN 203349569 12/2013
EP 2 759 785 7/2014
JP H10-220893 8/1998
JP 2000-146258 5/2000
JP 2004-347135 12/2004
KR 10-1233209 B1 5/2012
WO WO 2014-115240 7/2014

OTHER PUBLICATIONS

European Search Report dated Jun. 3, 2016 issued in Application No. 15 19 5188.6.
Chinese Office Action dated Aug. 20, 2018 issued in Application No. 201510349531.6 (English Translation Attached).

* cited by examiner

OUTDOOR DEVICE FOR AN AIR CONDITIONER

CROSS-REFERENCE TO RELATED APPLICATION(S)

The present application claims priority under 35 U.S.C. 119 and 35 U.S.C. 365 to Korean Patent Application No. 10-2014-0183411, filed in Korea on Dec. 18, 2014) and No. 10-2015-0056578, filed in Korea on Apr. 22, 2015, which are hereby incorporated by reference in their entirety.

BACKGROUND

1. Field

An outdoor device for an air conditioner is disclosed herein.

2. Background

Air conditioners are apparatuses that maintain air within a predetermined space at a most proper state according to a use and purpose thereof. In general, such an air conditioner may include a compressor, a condenser, an expansion device, and evaporator. Thus, the air conditioner has a refrigerant cycle in which compression, condensation, expansion, and evaporation processes of a refrigerant are performed. Thus, the air conditioner may heat or cool a predetermined space.

The predetermined space may be variously provided according to a place at which the air conditioner is used. For example, when the air conditioner is provided in a home or office, the predetermined space may be an indoor space of a house or building. On the other hand, when the air conditioner is provided in a vehicle, the predetermined space may be a space in which a person rides.

When the air conditioner performs a cooling operation, an outdoor heat-exchanger provided in an outdoor unit or device may serve as a condenser, and an indoor heat-exchanger provided in an indoor unit or device may serve as an evaporator. On the other hand, when the air conditioner performs a heating operation, the indoor heat-exchanger may serve as the condenser, and the outdoor heat-exchanger may serve as the evaporator.

Thus, when the air conditioner performs the cooling operation, the refrigerant introduced into the outdoor heat exchanger may be in a high-temperature, high-pressure gaseous state. To improve a condensation efficiency of the refrigerant, a number of branch paths which are branched into the outdoor heat exchanger may decrease, and a length of each of the branch paths may increase. That is, as a flow path of the refrigerant increases in length, a flow speed of the refrigerant may increase. Thus, as a condensation pressure is reduced, the condensation efficiency, that is, a rate at which the refrigerant changes into a liquid phase may be improved.

On the other hand, when the air conditioner performs the heating operation, the refrigerant introduced into the outdoor heat exchanger may have a two-phase state. To reduce a pressure loss of the refrigerant, the number of branch paths which are branched into the outdoor heat exchanger may increase, and a length of each of the branch paths may decrease. That is, the gaseous refrigerant of the two-phase refrigerant may increase in pressure loss during the flowing. Thus, when the flow path of the refrigerant decreases, and the number of branch paths increases, the pressure loss, that is, a loss in evaporation pressure may be prevented, improving the evaporation efficiency.

The present Applicant filed and registered, for a structure of an outdoor heat exchanger, Korean Registration No. KR10-1233209 (hereinafter "related art"), filed on Feb. 15, 2013, in Korea and entitled "Heat Pump", which is hereby incorporated by reference. According to the related art, a refrigerant passage of an outdoor heat exchanger may include a first unit passage and a second unit passage. One or a first side of the first unit passage and one or a first side of the second unit passage may be connected in parallel to each other by a first parallel connection passage. The other or a second side of the first unit passage and the other or a second side of the second unit passage may be connected in parallel to each other by a second parallel connection passage.

A first distributor and a second distributor are installed on the first parallel connection passage, and a first header and a second header are installed on the second parallel connection passage. The outdoor heat exchanger further includes a series connection passage that connects the first unit passage to the second unit passage in series when the cooling operation is performed. The series connection passage may be configured to bypass the refrigerant passing through the first unit passage toward an inlet of the second unit passage when the cooling operation is performed. The outdoor heat exchanger includes a passage switching unit or switch, which that is installed in the first and second parallel connection passages or the series connection passage to open or close each of the passages, that is, a series connection valve and a backflow prevention valve.

According to the outdoor heat exchanger having the above-described structure, a series connection passage that acts as a variable path may be provided to close the series connection passage when the heat operation is performed and to open the series connection passage when the cooling operation is performed. Thus, the passage may be complicated in structure, and a loss in pressure may occur in the tube through which the refrigerant flows. Also, as a separate series connection valve to open and close the series connection passage has to be provided, manufacturing costs may increase.

BRIEF DESCRIPTION OF THE DRAWINGS

Embodiments will be described in detail with reference to the following drawings in which like reference numerals refer to like elements, and wherein.

DETAILED DESCRIPTION

Figure 1:
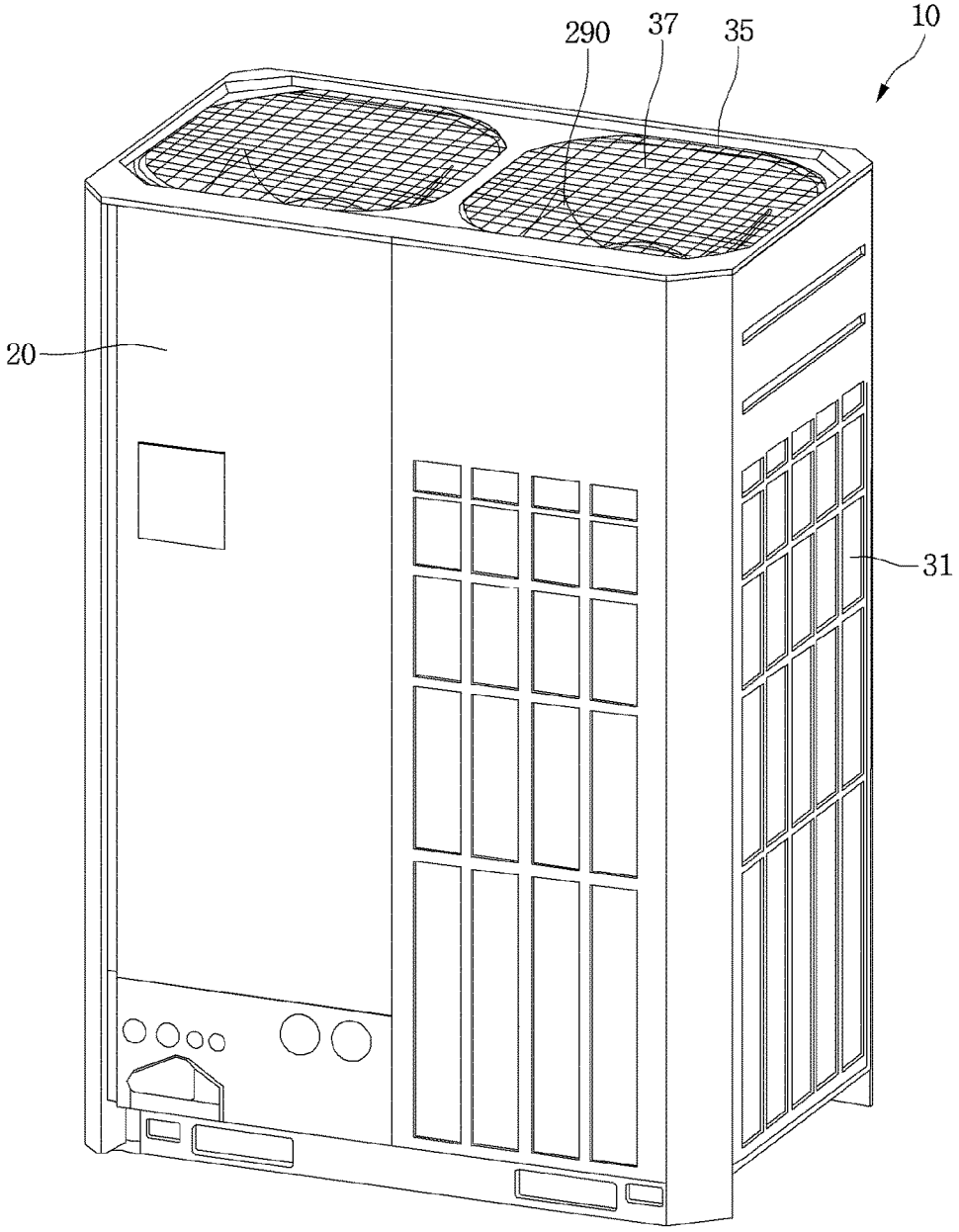
FIGS. 1 and 2 are views of an outdoor device for an air conditioner according to an embodiment.
Figure 2:
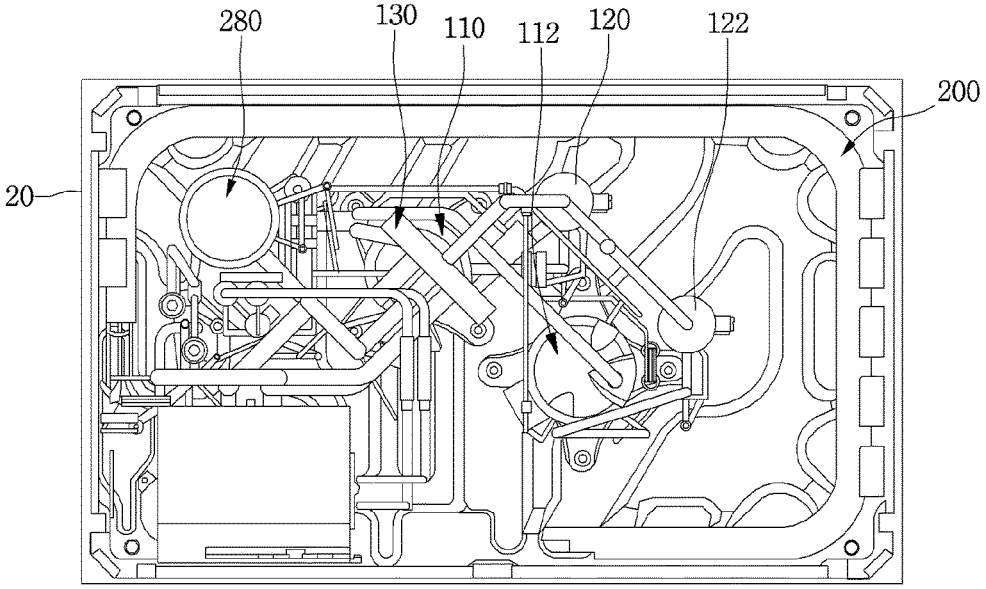
Figure 3:
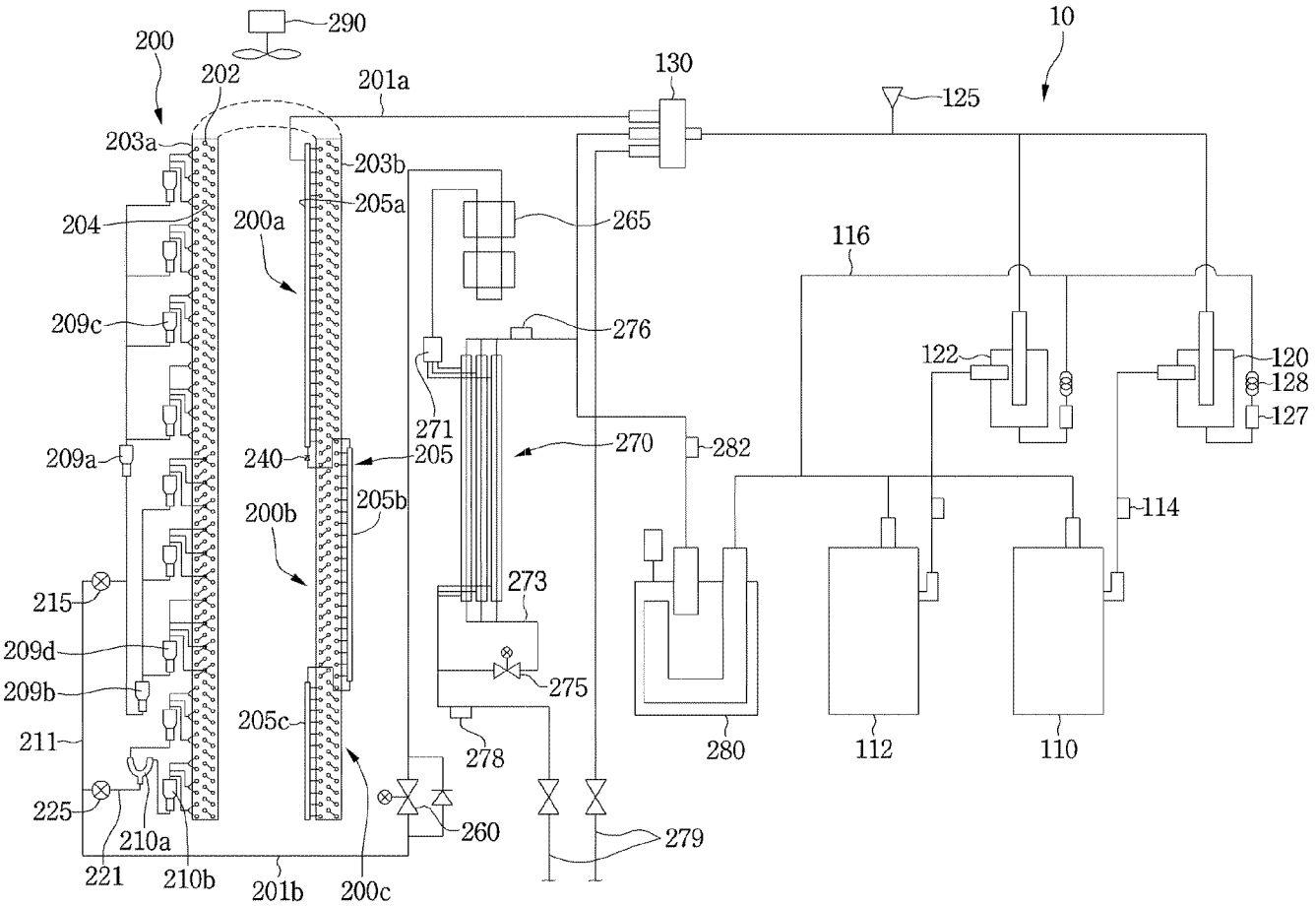
FIG. 3 is a system view of the outdoor device for an air conditioner according to an embodiment.
Figure 4:
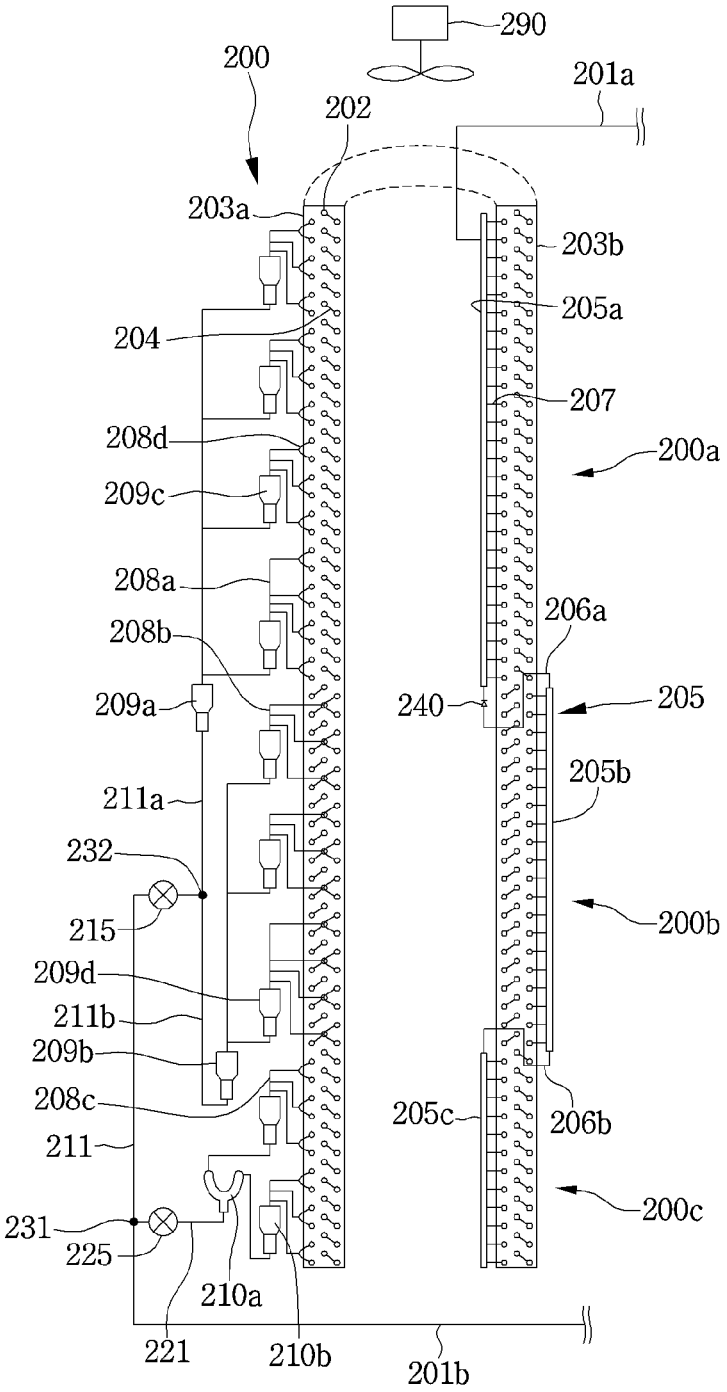
FIG. 4 is a view illustrating a main component of an outdoor heat exchanger for an air conditioner according to an embodiment.

FIGS. 1 and 2 are views of an outdoor device for an air conditioner according to an embodiment. FIG. 3 is a system view of the outdoor device for an air conditioner according to an embodiment. FIG. 4 is a view illustrating a main component of an outdoor heat exchanger for an air conditioner according to an embodiment.

Referring to FIGS. 1 to 3, an outdoor unit or device for air conditioner 10 according to an embodiment. The outdoor device may be provided in an outer space and be in communication with an indoor or device provided in an inner space. The indoor device may include an indoor heat exchanger heat-exchanged with air of the indoor space. FIG. 1 illustrates the outdoor device.

The outdoor device for an air conditioner 10 may include a plurality of compressors 110 and 112, and a plurality of oil separators 120 and 122, respectively, provided on or at outlet-sides of the plurality of compressors 110 and 112 to separate oil from a refrigerant discharged from the plurality of compressors 110 and 112. The plurality of compressors 110 and 112 may include a first compressor 110 and a second compressor 112, which may be connected in parallel to each other. A discharge temperature sensor 114 that detects a temperature of the compressed refrigerant may be provided on or at an outlet-side of each of the first and second compressors 110 and 112. The plurality of oil separators 120 and 122 may include a first oil separator 120 provided on or at the outlet-side of the first compressor 110, and a second oil separator 122 provided on or at the outlet-side of the second compressor 112.

The outdoor device for an air conditioner 10 may include a collection passage 116 that collects the oil from the oil separators 120 and 122 into the compressors 110 and 112. The collection passage 116 may extend from each of the outlet-sides of the first and second oil separators 120 and then be combined into one passage. The combined passage may be connected to an inlet-side tube of each of the first and second compressors 110 and 112. A dryer 127 and a capillary 128 may be provided in the collection passage 116.

A high-pressure sensor 125 that detects a discharge pressure of the refrigerant discharged from the compressors 110 and 112 and a flow switch 130 that guides the refrigerant passing through the high-pressure sensor 125 to an outdoor heat exchanger 200 or the indoor device may be provided on or at the outlet-sides of the oil separators 120 and 122. For example, the flow switch 130 may include a four-way valve.

When the outdoor device for an air conditioner 10 operates in a cooling mode, the refrigerant may be introduced from the flow switch 130 into the outdoor heat exchanger 200. On the other hand, when the outdoor device for an air conditioner 10 operates in a heating mode, the refrigerant may flow from the flow switch 130 into an indoor heat exchange-side of the indoor device (not shown).

When the outdoor device for an air conditioner 10 operates in the cooling mode, the refrigerant condensed in the outdoor heat exchanger 200 may pass through a main expansion valve 260 (electronic expansion valve). The main expansion valve 260 may be fully opened so that the refrigerant is not decompressed. That is, the main expansion valve 260 may be provided in or at an outlet-side of the outdoor heat exchanger 200 when the cooling operation is performed.

The refrigerant passing through the main expansion valve 260 may pass through a heatsink plate 265. The heatsink plate 265 may be provided on an electronic unit or device including a heating component.

For example, the heat generation component may include an intelligent power module (IPM). The IPM may be drive circuit of a power device, such as a power MOSFET or IGBT and a protection circuit having a self protection function. The condensed refrigerant may flow into the heatsink plate 265 to cool the heat generation component.

The outdoor device for an air conditioner 10 may further include a supercooling heat exchanger 270, to which the refrigerant passing through the heat-sink plate 265 may be introduced, and a supercooling distributor 271 provided on or at an inlet-side of the supercooling heat exchanger 270 to branch the refrigerant flow. The supercooling heat exchanger 270 may serve as an intermediate heat exchanger, in which a first refrigerant circulated into the system and a portion (a second refrigerant) of the first refrigerant may be heat-exchanged with each other after the refrigerant is branched.

The first refrigerant may be a refrigerant, which may be introduced into the supercooling heat exchanger 270 via the supercooling distributor 271, and thus, may be supercooled by the second refrigerant. On the other hand, the second refrigerant may absorb heat from the first refrigerant.

The outdoor device for an air conditioner 10 may include a supercooling passage 273 provided on or at an outlet-side of the supercooling heat exchanger 270 to branch the second refrigerant from the first refrigerant. A supercooling expansion device 275 that decompresses the second refrigerant may be provided in the supercooling passage 273. The supercooling expansion device 275 may include an electronic expansion valve (EEV).

The second refrigerant of the supercooling passage 273 may be introduced into the supercooling heat exchanger 270, and then, may be heat-exchanged with the first refrigerant to flow toward an inlet-side of a gas/liquid separator 280. The outdoor device for an air conditioner 10 may further include a supercooling discharge temperature sensor 276 that detects a temperature of the second refrigerant passing through the supercooling heat exchanger 270.

The gas/liquid separator 280 may separate a gaseous refrigerant from the refrigerant before the refrigerant is introduced into the compressors 110 and 112. The gaseous refrigerant separated by the gas/liquid separator 280 may be introduced into the compressors 110 and 112.

While the refrigeration cycle is driven, the evaporated refrigerant may be introduced into the gas/liquid separator 280 via the flow switch 130. The evaporated refrigerant may be mixed with the second refrigerant passing through the supercooling heat exchanger 270, and then, be introduced into the gas/liquid separator 280.

A suction temperature sensor 282 that detects a temperature of the refrigerant to be suctioned into the compressors 110 and 112 may be provided on or at the inlet-side of the gas/liquid separator 280. The first refrigerant passing through the supercooling heat exchanger 270 may be introduced into the indoor device through an indoor device connection tube 279. The outdoor device for an air conditioner 10 may further include a liquid tube temperature sensor 278 provided on or at the outlet-side of the supercooling heat exchanger 270 to detect a temperature of the first refrigerant passing through the supercooling heat exchanger 270, that is, a temperature of the supercooled refrigerant.

The outdoor device for an air conditioner 10 may include a cabinet 20 that defines an outer appearance thereof and accommodates the above-described components. The cabinet 20 may include a suction hole 31, through which external air may be suctioned in, and a discharge hole 35, through which the external air suctioned in through the suction hole 31 may be heat-exchanged and then discharged. A discharge grill 37 may be provided on the discharge hole 35. For example, a plurality of the suction hole 31 may be provided in a side surface of the cabinet 20, and the discharge hole 35 may be defined in a top surface of the cabinet 20.

The outdoor device for an air conditioner 10 may include a blower fan 290 that generates a flow of air from the plurality of suction hole 31 to the discharge hole 35. The blower fan 290 may be provided on an upper portion of the cabinet 20 and below the discharge hole 35.

The outdoor heat exchanger 200 may be bent several times along an inner surface of the cabinet 20. The bent surface of the outdoor heat exchanger 200 may be provided at a position corresponding to each of the plurality of suction holes 31.

The blower fan 290 may be provided above the outdoor heat exchanger 200. Thus, an upper portion of the outdoor heat exchanger 200 may be close to the blower fan 290, and a lower portion of the outdoor heat exchanger 200 may be separated from the blower fan 290. Due to the above-described structure, a flow amount of air passing through the upper portion of the outdoor heat exchanger 200 may be less than a flow amount of air passing through the lower portion of the outdoor heat exchanger 200.

When the blower fan 290 operates, the air suctioned through the plurality of suction hole 31 may flow in an upward direction after passing through each of the bent surfaces of the outdoor heat exchanger 200, and then, may be discharged to the outside through the discharge hole 35.

Hereinafter, components of the outdoor heat exchanger 200 and peripheral components thereof will be described.

The outdoor device for an air conditioner 10 may include a first inlet/outlet tube 201*a* connected from the flow switch 130 to one or a first side of the outdoor heat exchanger 200, and a second inlet/outlet tube 201*b* that extends from the other or a second side of the outdoor heat exchanger 200 to the main expansion device 260. For example, the first inlet/outlet tube 201*a* may be connected to an upper portion of a header 205, that is, a first header 205*a*, and the second inlet/outlet tube 201*b* may be connected to a lower portion of the header 205, that is, a third header 205*c*.

When the outdoor device for an air conditioner 10 performs the cooling operation, the refrigerant may be introduced into the outdoor heat exchanger 200 through the first inlet/outlet tube 201*a* and may be discharged from the outdoor heat exchanger 200 through the second inlet/outlet tube 201*b*. On the other hand, when the outdoor device for an air conditioner 10 performs the heating operation, the refrigerant may be introduced into the outdoor heat exchanger 200 through the second inlet/outlet tube 201*b* and may be discharged from the outdoor heat exchanger 200 through the first inlet/outlet tube 201*a*.

As described above, the blower fan 290 may be provided above the outdoor heat exchanger 200. The outdoor heat exchanger 200 may include three heat exchangers 200*a*, 200*b*, and 200*c*.

The three heat exchangers 200*a*, 200*b*, and 200*c* may include a first heat exchangers 200*a* provided in an upper portion of the outdoor heat exchanger 200 at a position closest to the blower fan 290, a second heat exchanger 200*b* provided at an approximately central portion of the outdoor heat exchanger 200 at a position which is relatively far away from the blower fan 290 when compared to the first heat exchanger 200*a*, and a third heat exchanger 200*c* provided in a lower portion of the outdoor heat exchanger 200 at a position which is relatively far away from the blower fan 290 compared to the second heat exchanger 200*b*. Each of the heat exchangers may include a refrigerant tube 202 having a plurality of rows and stages. For example, a plurality of the refrigerant tube 202 may be provided, so that the plurality of refrigerant tubes 202 may be arranged in three rows in a horizontal direction and stepped in plural stages in a vertical direction. The plurality of refrigerant tubes 202 may be provided spaced apart from each other.

The plurality of refrigerant tubes 202 may be bent to extend lengthwise. For example, in FIG. 4, the plurality of refrigerant tubes 202 may extend again in a forward direction after extending in a backward direction from the ground. In this case, each of the plurality of refrigerant tubes 202 may have a bent or curved U shape.

Each of the heat exchangers may further include coupling plates 203*a* and 203*b* that supports the refrigerant tube 202. The coupling plates 203*a* and 203*b* may include a first plate 203*a* that supports one or a first side of the refrigerant tube 202 having the bent shape, and a second plate 203*b* that supports the other or a second side of the refrigerant tube 202. Each of the first and second plates 203*a* and 203*b* may extend lengthwise in a vertical direction.

An upper portion, a central portion, and a lower portion of each of the first and second coupling plates 203*a* and 203*b* may form the first to third heat exchangers 200*a*, 200*b*, and 200*c*, respectively. Each of the heat exchangers 200*a*, 200*b*, and 200*c* may further include a return tube 204 coupled to an end of each of the plurality of refrigerant tubes 202 to guide the refrigerant flowing in one refrigerant tube 202 into the other refrigerant tube 202. A plurality of the return tube 204 may be provided and be coupled to the first and second plates 203*a* and 203*b*.

The outdoor heat exchanger 200 may further include the header 205 that defines a flow space for the refrigerant. The header 205 may branch the refrigerant and introduce the branched refrigerant into the plurality of refrigerant tubes 202 according to the cooling or heating operation of the outdoor device for an air conditioner 10 or mix the refrigerant heat-exchanged in the plurality of refrigerant tubes 202. The header 205 may extend lengthwise in a vertical direction to correspond to an extension direction of the second plate 203*b*.

The header 205 may include the first header 205*a*, a second header 205*b*, and the third header 205*c*, which may be spaced apart from each other. The first to third headers 205*a* and 205*c* may form the first to third heat exchangers 200*a*, 200*b*, and 200*c*, respectively. The header 205 may include the first header 205*a* provided at a position corresponding to an upper portion of the first plate 203*b*, the second header 205*b* provided under the first header 205*a* at a position corresponding to a central portion of the second plate 203*b*, and the third header 205*c* provided under the second header 205*c* at a position corresponding to a lower portion of the second plate 203*b*.

The outdoor device for an air conditioner 10 may include a first connection tube 206*a* that connects the first header 205*a* to the second header 205*b*. That is, the first connection tube 206*a* may be a tube that connects the first heat exchanger 200*a* to the second heat exchanger 200*b*. For example, the first connection tube 206*a* may extend from a lower portion of the first header 205*a* to an upper portion of the second header 205*b*.

The outdoor device for an air conditioner 10 may further include a check valve 240 provided in the first connection tube 206*a* to guide a flow of the refrigerant in one direction. The check valve 240 may guide a flow of the refrigerant from the second header 205*b* to the first header 205*a* and restrict a flow of the refrigerant from the first header 205*a* to the second header 205*b*.

The outdoor device for an air conditioner 10 may include a second connection tube 206*b* that connects the second header 205*b* to the third header 205*c*. That is, the second connection tube 206*b* may be a tube that connects the second heat exchanger 200*b* to the third heat exchanger 200*c*. For example, the second connection tube 206*a* may extend from a lower portion of the second header 205*b* to an upper portion of the third header 205*c*.

A plurality of refrigerant inflow tubes 207 may extend from the heat exchangers, respectively. The plurality of refrigerant inflow tubes 207 may extend from the first to third headers 205*a*, 205*b*, and 205*c* to the second plate 203*b*, respectively. In other words, the plurality of refrigerant inflow tubes 207 may extend from the header 205 and may be connected to the refrigerant tube 202 supported by the second plate 203*b*. Also, the plurality of refrigerant inflow tubes 207 may be vertically spaced apart from each other.

When the outdoor device for an air conditioner 10 performs the cooling operation, the refrigerant of the first header 205*a* may be introduced into the refrigerant tube 202 of the first heat exchanger 200*a* through the plurality of refrigerant inflow tubes 207. The refrigerant within the refrigerant tube 202 of the second heat exchanger 200*b* may be introduced into the second header 205*b* through the plurality of refrigerant inflow tube 207. The refrigerant within the third header 205*c* may be introduced into the refrigerant tube 202 of the third heat exchanger 200*c* through the plurality of refrigerant inflow tubes 207. On the other hand, when the outdoor device for an air conditioner 10 performs the heating operation, the refrigerant of the refrigerant tube 202 may be introduced into the first to third headers 205*a*, 205*b*, and 205*c* through the plurality of refrigerant inflow tubes 207.

The outdoor device for an air conditioner 10 may include first and second distribution tubes 211 and 221, which may be branched from the second inlet/outlet tube 201*b* to the plurality of refrigerant tubes 202 of the outdoor heat exchanger 200 when the heating operation is performed. The first and second distribution tubes 211 and 221 may be branched from a first branch 231.

The outdoor device for an air conditioner 10 may further include a first valve 215 provided in the first distribution tube 211 to adjust an amount of refrigerant flowing through the first distribution tube 211, and a second valve 225 provided in the second distribution tube 221 to adjust an amount of refrigerant flowing through the second distribution tube 221. Each of the first and second valves 215 and 225 may include an electric expansion valve (EEV), an opening degree of which may be adjustable. The amount of refrigerant flowing through each of the first and second distribution tubes 211 and 221 may increase or increase according to an opening degree of each of the first and second valves 215 and 225.

The outdoor device for an air conditioner 10 may include a first branch tube 211*a* and a second branch tube 211*b*, which may be branched from the first distribution tube 211. The first and second branch tubes 211*a* and 211*b* may be branched from a second branch 232.

The outdoor device for an air conditioner 10 may further include a first distributor 209*a* provided in the first branch tube 211*a*, and a second distributor 209*b* provided in the second branch tube 211*b*. The refrigerant flowing through the first branch tube 211*a* may be distributed into a plurality of paths via the first distributor 209*a*, and the refrigerant flowing through the second distribution tube 211*b* may be distributed into a plurality of paths via the second distributor 209*b*. The outdoor device for an air conditioner 10 may further include a third distributor 209*c* provided in each of the paths branched from the first distributor 209*a*, and a fourth distributor 209*d* provided in each of paths branched from the second distributor 209*b*.

The outdoor device for an air conditioner 10 may further include a plurality of first capillary tubes 208*a* coupled to an outlet-side of the third distributor 209*c*, and a plurality of second capillary tubes 208*b* coupled to an outlet-side of the fourth distributor 209*d*. The plurality of first capillary tubes 208*a* may be one component of the first heat exchanger 200*a*. The plurality of first capillary tube 208*a* may be connected to the refrigerant tube 202 provided in the first heat exchanger 200*a* to supply a refrigerant. When the heating operation is performed, the refrigerant flowing through the first branch tube 211*a* may pass through the first and third distributors 209*a* and 209*c*, and then may be distributed into the plurality of first capillary tubes 208*a* to flow into the first heat exchanger 200*a*. On the other hand, the refrigerant flowing through the second branch tube 211*b* may pass through the second and fourth distributors 209*b* and 209*d*, and then, may be distributed into the plurality of second capillary tubes 208*a* to flow into the second heat exchanger 200*b*.

In summary, the refrigerant branched from the first branch 231 to flow into the first distribution tube 211 may be introduced into the first and second heat exchangers 200*a* and 200*b* and then heat-exchanged. The first valve 215 may adjust an amount of refrigerant flowing into the first and second heat exchangers 200*a* and 200*b*.

According to installation structures of the first and third distributors 209*a* and 209*c* and the second and fourth distributors 209*b* and 209*d*, the refrigerant may be distributed in multi-stages. Thus, a number of flow paths may increase, improving a heat exchange efficiency when the heating operation is performed.

The outdoor device for an air conditioner 10 may include a fifth distributor 210*a* provided on the second distribution tube 221 to branch the refrigerant into a plurality of paths, and a sixth distributor 210*b* provided in each of the paths branched from the fifth distributor 210*a* to branch the refrigerant into a plurality of paths. The outdoor device for an air conditioner 10 may further include a plurality of third capillary tubes 208*c* coupled to an outlet-side of the sixth distributor 210*b*. The plurality of third capillary tube 208*c* may be one component of the third heat exchanger 200*c*. The plurality of third capillary tube 208*c* may be connected to the refrigerant tube 202 provided in the third heat exchanger 200*c* to supply a refrigerant. When the heating operation is performed, the refrigerant flowing through the first branch 231 to flow through the second distribution tube 221 may pass through the fifth and sixth distributors 210*a* and 210*b*, and then may be distributed into the plurality of third capillary tubes 208*c* to flow into the third heat exchanger 200*c*.

Each of the heat exchangers may further include a branch connection tube 208*d* that connects the plurality of first to third capillary tubes 208*a*, 208*b*, and 208*c* to the refrigerant tube 202. The branch connection tube 208*d* may branch the refrigerant flowing through the first to third capillary tubes 208*a*, 208*b*, and 208*c* in two directions to branch the refrigerant into one refrigerant tube 202 and the other refrigerant tube 202. For example, the branch connection tube 208*d* may have a Y shape so that the branch connection tube 208*d* has one inlet and two outlets. A plurality of the branch connection tube 208*d* may be provided to correspond to a number of first to third capillary tubes 208*a*, 208*b*, and 208*c*.

The number of branched refrigerant passages may gradually increase, or each of the refrigerant passages may gradually increase in length toward an upper side of the outdoor heat exchanger 200. As described above, as the blower fan 290 is provided above the outdoor heat exchanger 200, an amount of air passing through the first heat exchanger 200*a* of the first to third heat exchangers 200*a*, 200*b*, and 200*c* may be largest. Thus, it is necessary to maximize an amount of refrigerant flowing through the first heat exchanger 200*a*.

For this, in or at the first branch 231, the refrigerant may be branched into the first and second heat exchangers 200*a* and 200*b*, in or for which a relatively large amount of refrigerant may be required, and the third heat exchanger 200*c* in or for which a relatively small amount of refrigerant may be required. Also, the valves 215 and 225 may be provided in the each of the passages to adjust a flow amount of refrigerant.

In or at the second branch 232, the refrigerant may be branched into the first and second heat exchangers 200*a* and 200*b*, and a number of refrigerant passages toward the first heat exchanger 200*a* may be greater than a number of refrigerant passages toward the second heat exchanger 200*b*. For example, as illustrated in FIG. 4, four passages are branched from the first distributor 209*a*, and at least three passages are branched from the third distributor 209*c*. At least 12 passages of the refrigerant introduced into the first heat exchanger 200*a* may be provided. That is, four third distributors 209*c* may be provided.

On the other hand, three passages may be branched from the second distributor 209*b*, and three passages may be branched from the fourth distributor 209*d*. Thus, a total of nine passages of the refrigerant introduced into the second heat exchanger 200*b* may be provided. That is, three fourth distributors 209*d* may be provided.

On the other hand, two passages may be branched from the fifth distributor 210*a*, and three passages may be branched from the sixth distributor 210*b*. Thus, a total of six passages of the refrigerant introduced into the third heat exchanger 200*b* may be provided. That is, two sixth distributors 210*b* may be provided.

As described above, a different number of refrigerant passages may be branched from the first branch 231, and a different number of refrigerant passages may be branched from the second branch 232. The number of branched passages at the upper side may be greater than the number of branched passages at the lower side. Thus, according to the above-described structure, a large amount of refrigerant may flow at the upper side of the outdoor heat exchanger 200 to increase a heat exchange amount.

Hereinafter, a flow of the refrigerant in the outdoor device for an air conditioner when the outdoor device for an air conditioner performs the heating operation and the cooling operation will be described with reference to FIGS. 5 and 6.

Figure 5:
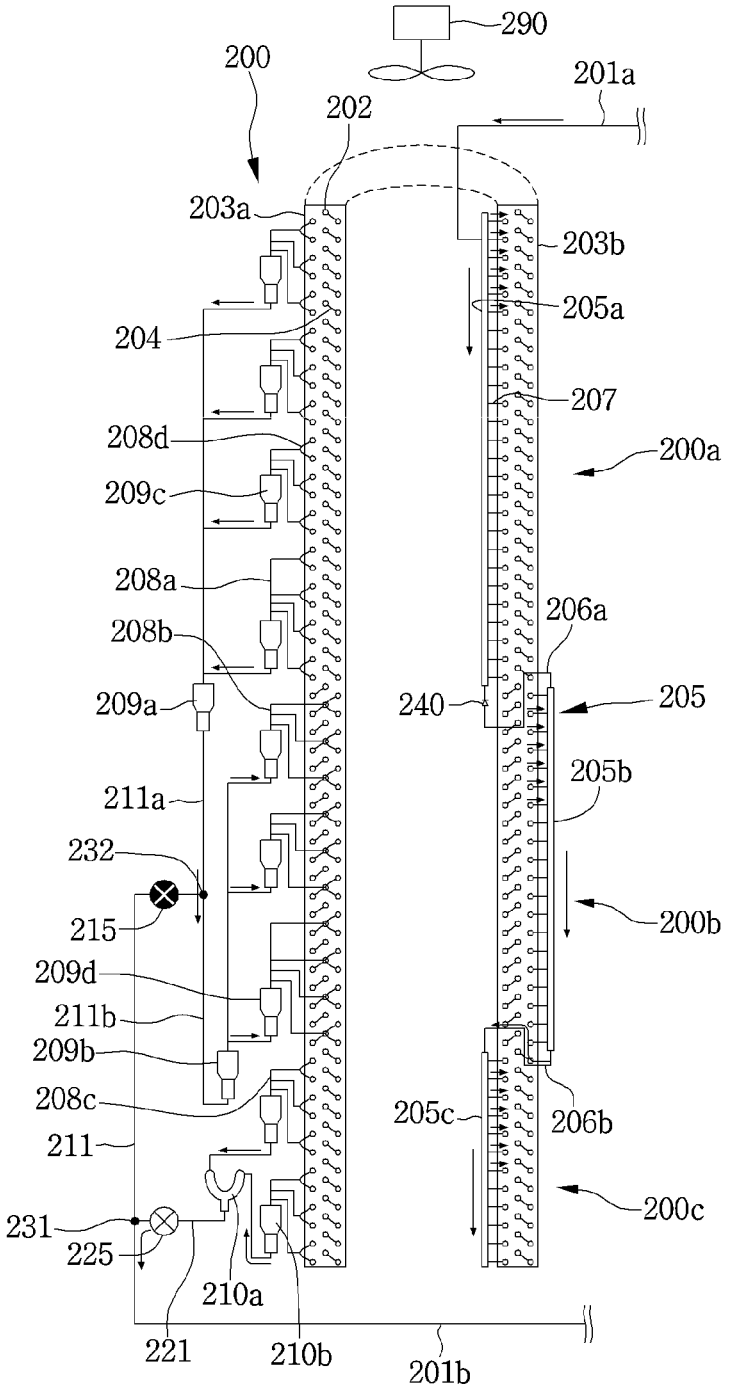
FIG. 5 is a view illustrating a flow of refrigerant when the outdoor device for an air conditioner performs a cooling operation.

FIG. 5 is a view illustrating a flow of refrigerant when the outdoor device for an air conditioner performs a cooling operation. FIG. 6 is a view illustrating a flow of refrigerant when the outdoor device for an air conditioner performs a heating operation.

Referring to FIG. 5, when the outdoor device for an air conditioner performs the cooling operation, a high-temperature, high-pressure refrigerant compressed in the first and second compressors 110 and 112 may be separated from oil while passing through the first and second oil separators 120 and 122, and then, the separated oil may return to the first and second compressors 110 and 112 through the collection passage 116. The refrigerant from which the oil is separated may flow into the first inlet/outlet tube 201*a* via the flow switch 130, and then, may be introduced into the first heat exchanger 200*a* of the outdoor heat exchanger 200 through the first header 205*a*.

The first to third heat exchangers 200*a*, 200*b*, and 200*c* may be connected to each other in series. The refrigerant may successively flow in order of the first, second, and third heat exchangers 200*a*, 200*b*, and 200*c*.

The refrigerant introduced into the first header 205*a* may be introduced into the refrigerant tube 202 supported by the second coupling plate 203*b* through the plurality of refrigerant inflow tubes 207. A tube connected to the first header 205*a* to introduce the refrigerant may be referred to as a "refrigerant tube of the first heat exchanger" or a "first refrigerant tube". The refrigerant may be heat-exchanged with external air while flowing in the refrigerant tube 202 supported by the first coupling plate 203*a*. The introduction of the refrigerant of the first header 205*a* into the second header 205*b*, that is, the second heat exchanger 200*b* may be restricted.

The refrigerant heat-exchanged while flowing through the first refrigerant tube 202 may successively flow in order of the plurality of first capillary tubes 208*a*, the third distributor 209*c*, the first distributor 209*a*, and the first branch tube 211*a*. That is, the refrigerant may be introduced into the first heat exchanger 200*a* through the first header 205*a*, and then, may be discharged from the first heat exchanger 200*a* through the plurality of first capillary tubes 208*a*.

The first valve 215 may be closed. Thus, a flow of the refrigerant of the first branch tube 211*a* into the first distribution tube 211 may be restricted to flow into the second branch tube 211*b*.

The refrigerant of the second branch tube 211*b* may be introduced into the second heat exchanger 200*b* through the second distributor 209*b*, the fourth distributor 209*d*, and the plurality of third capillary tubes 208*c*. The refrigerant may be introduced into the refrigerant tube 202 supported by the first coupling plate 203*a*, and then, may be heat-exchanged with external air while flowing in the refrigerant tube 202 supported by the second coupling plate 203*b*.

The refrigerant may be introduced into the second header 205*b* through the plurality of refrigerant inflow tubes 207. The refrigerant tube 202 connected to the second header 205*b* may be referred to as a "refrigerant tube of the second heat exchanger" or a "second refrigerant tube". That is, the refrigerant may be introduced into the second heat exchanger 200*b* through the plurality of third capillary tubes 208*c*, and then may be discharged from the second heat exchanger 200*b* through the second header 205*b*.

The refrigerant of the second header 205*b* may be introduced into the third header 205*c* of the third heat exchanger 200*c* through the second connection tube 206*b*. The refrigerant of the third header 205*c* may be introduced into the refrigerant tube 202 supported by the second coupling plate 203*b* through the refrigerant inflow tube 207. The refrigerant tube 202 connected to the third header 205*c* may be referred to as a "refrigerant tube of the third heat exchanger" or a "third refrigerant tube".

The refrigerant may be heat-exchanged with external air while flowing in the refrigerant tube 202 supported by the first coupling plate 203*a* to flow into the second distribution tube 221 via the plurality of third capillary tube 208*c*, the sixth distributor 210*b*, and the fifth distributor 210*a*. The second valve 225 may be opened, and thus, the refrigerant of the second distribution tube 221 may be discharged into the second inlet/outlet tube 201*b*.

As described above, when the outdoor device for an air conditioner 10 performs the cooling operation, the refrigerant may be condensed while successively passing through the first to third heat exchangers 200*a*, 200*b*, and 200*c*. That is, the refrigerant introduced into the outdoor heat exchanger 200 may be primarily condensed in the refrigerant tube 202 connected to the first header 205*a*, secondarily condensed in the refrigerant tube 202 connected to the second header 205*b*, and tertiary condensed in the refrigerant tube 202 connected to the third header 205*c*. Thus, the flow path of the refrigerant may increase in length, and the number of paths branched from the refrigerant tube 202 may increase. As a result, the flow rate of the refrigerant may increase, and the condensation pressure may be reduced, improving condensation efficiency.

Figure 6:
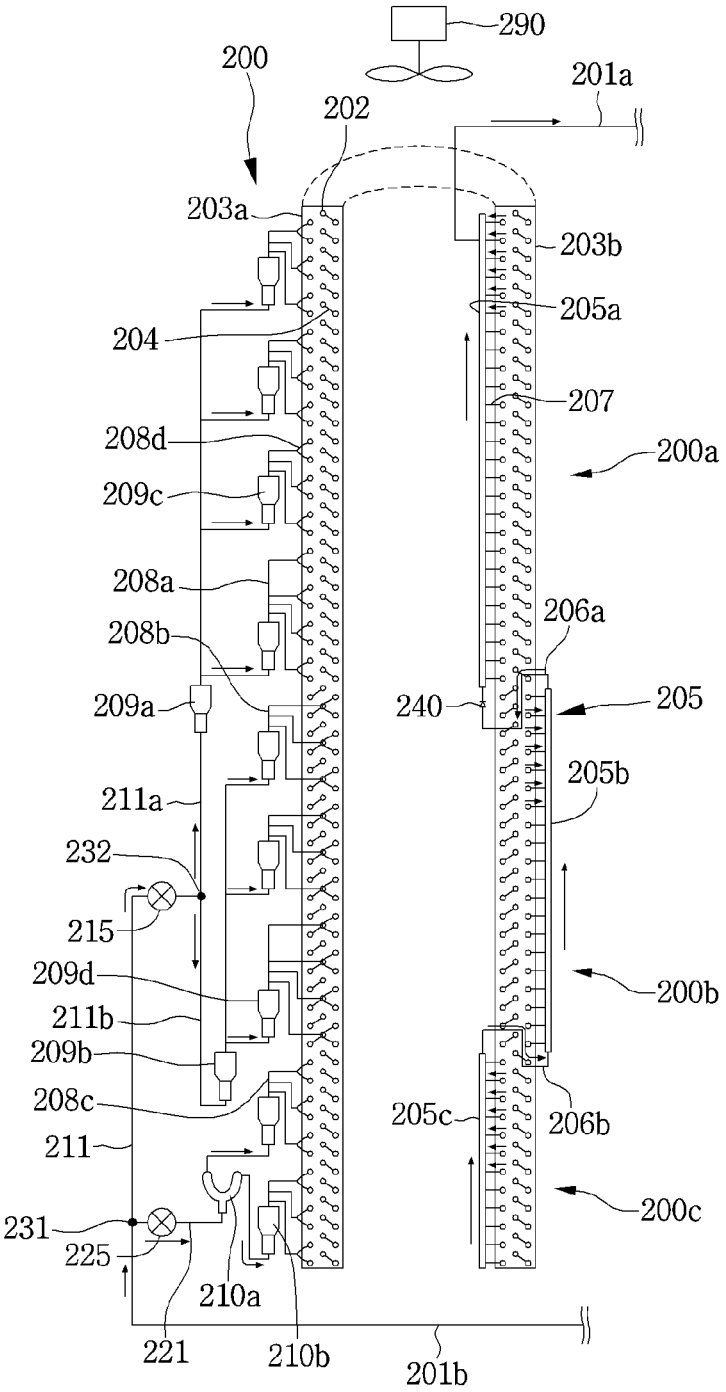
FIG. 6 is a view illustrating a flow of refrigerant when the outdoor device for an air conditioner performs a heating operation.

Referring to FIG. 6, when the outdoor device for an air conditioner performs the heating operation, a high-temperature, high-pressure refrigerant compressed in the first and second compressors 110 and 112 may be separated from oil while passing through the first and second oil separators 120 and 122, and then, the separated oil may return to the first and second compressors 110 and 112 through the collection passage 116. The refrigerant from which the oil may be separated may flow toward the indoor device via the flow switch 130.

The refrigerant introduced into the indoor device may be condensed in the indoor heat exchanger, and the condensed refrigerant may be introduced into the supercooling heat exchanger 270 through the indoor device connection tube 279. A portion of the refrigerant may be divided from the supercooling passage 273 and decompressed in the supercooling expansion device 275, and then, may be introduced into the supercooling heat exchanger 270.

Thus, the condensed refrigerant and the refrigerant flowing through the supercooling passage 273 may be heat-exchanged with each other to supercool the condensed refrigerant. The supercooled refrigerant passing through the supercooling heat exchanger 270 may cool the heating components of the electronic device while passing through the heatsink plate 265, and then, may be decompressed in the main expansion valve 260.

The first to third heat exchangers 200*a*, 200*b*, and 200*c* may be connected in parallel to each other. The refrigerant may be branched into the first to third heat exchangers 200*a*, 200*b*, and 200*c* to flow therethrough.

The refrigerant decompressed in the main expansion valve 260 may be branched from the first branch 231 to the first and second distribution tubes 211 and 221. The first and second valves 215 and 225 may be opened, and thus, the refrigerant passage provided in the first and second heat exchangers 200*a* and 200*b* may have a length greater than a length of the refrigerant passage provided in the third heat exchanger 200*c*. As a result, an amount of refrigerant flowing through the first distribution tube 211 may be greater than an amount of refrigerant flowing through the second distribution tube 211.

Also, the amount of refrigerant flowing through each of the first and second distribution tubes 211 and 221 may be adjusted according to an opening degree of each of the first and second valves 215 and 225. For example, to increase the flow amount of refrigerant into the first distribution tube 211, the opening degree of the second valve 225 may be reduced. The refrigerant flowing through the first distribution tube 211 may be branched from the second branch 232 to the first and second branch tubes 211*a* and 211*b* via the first valve 215.

The refrigerant of the first branch tube 211*a* may be branched into a plurality of paths through the first distributor 209*a*, and each of the paths may be branched again into a plurality of paths through the third distributor 209*c*. Then, the refrigerant may be introduced into the first heat exchanger 200*a* through the plurality of first capillary tubes 208*a*.

The refrigerant of the second branch tube 211*b* may be branched into a plurality of paths while passing through the second distributor 209*b*, and the refrigerant in each of the paths may be branched again into a plurality of paths through the fourth distributor 209*d*. Then, the refrigerant may be introduced into the second heat exchanger 200*b* through the plurality of second capillary tubes 208*b*.

As described above, as the number or size of passages of the refrigerant introduced into the first heat exchanger 200*a* is greater than the number of passages of the refrigerant introduced into the second heat exchanger 200*b*, a relatively large amount of refrigerant may be introduced into the first heat exchanger 200*a*. The refrigerant introduced into the first and second heat exchangers 200*a* and 200*b* may be heat-exchanged with the external air while flowing in the refrigerant tube 202 supported by the second coupling plate 203*b* of each of the heat exchangers, and then, may be introduced into the first header 205*a* of the first heat exchanger 200*a* and the second header 205*b* of the second heat exchanger 200*b* through the refrigerant inflow tube 207. That is, the refrigerant introduced into the first heat exchanger 200*a* through the plurality of first capillary tubes 208*a* may be discharged from the first heat exchanger 200*a* through the first header 205*a*.

Also, the refrigerant introduced into the second heat exchanger 200*b* through the plurality of second capillary tubes 208*b* may be discharged from the second heat exchanger 200*b* through the second header 205*b*. The refrigerant discharged from the second heat exchanger 200*b* may be introduced into the first header 205*a* through the first connection tube 206*a*. As a result, the refrigerant circulating in the second heat exchanger 200*b* may be mixed with the refrigerant circulating into the first heat exchanger 200*a* in the first header 205*a*.

The refrigerant flowing from the first branch 231 to the second distribution tube 221 may pass through the second valve 225, and then, may be branched into a plurality of paths through the fifth distributor 210*a*. The refrigerant in each of the paths may be branched into a plurality of paths through the sixth distributor 210*b*, and then, may be introduced into the third heat exchanger 200*c* through the plurality of third capillary tubes 208*c*.

The refrigerant introduced into the third heat exchanger 200*c* may be heat-exchanged with the external air while flowing in the refrigerant tube 202 supported by the second coupling plate 203*b*, and then, may be introduced into the third header 205*a* of the third heat exchanger 200*c* through the plurality of refrigerant inflow tube 207. The refrigerant introduced into the third heat exchanger 200*c* through the plurality of second capillary tubes 208*c* may be discharged from the third heat exchanger 200*c* through the third header 205*c*.

The refrigerant discharged from the third heat exchanger 200*c* may be introduced into the second header 205*b* through the second connection tube 206*b*. As a result, the refrigerant circulating into the third heat exchanger 200*b* may be mixed with the refrigerant circulating in the second heat exchanger 200*b* in the second header 205*b*.

Also, as described above, the refrigerant of the second header 205*b* may be introduced into the first header 205*a* via the first connection tube 206*a* and the check valve 240. Thus, the refrigerant heat-exchanged in the first to third heat exchangers 200*a*, 200*b*, and 200*c* may be collected into the first header 205*a*.

The refrigerant of the first header 205*a* may be discharged from the outdoor heat exchanger 200 through the first inlet/outlet tube 201*a*. The refrigerant discharged from the outdoor heat exchanger 200 may be introduced into the gas/liquid separator 280 via the flow switch 130, and the separated gaseous refrigerant may be suctioned into the first and second compressors 110 and 112. This cycle may be repeatedly performed.

As described above, when the outdoor device for an air conditioner 10 performs the heating operation, the refrigerant may be distributed in multi-stages through the first to sixth distributors 209*a*, 209*b*, 209*c*, 209*d*, 210*a*, and 210*b* and then, may be branched into the plurality of refrigerant paths. The refrigerant branched into each of the paths may be introduced into the plurality of refrigerant tubes 202, and then, may be heat-exchanged with the external air. Thus, the flow path of the refrigerant in the outdoor heat exchanger 200 may decrease in length, and the number of paths branched to the outdoor heat exchanger 200 may increase. Therefore, loss in pressure of the refrigerant may be reduced, and thus, a decrease in evaporation pressure may be prevented, improving evaporation efficiency.

According to embodiments disclosed herein, when the outdoor device for an air conditioner performs the cooling operation and the heating operation, as a number of paths through which the refrigerant may pass through the outdoor heat exchanger and a length of each of the paths are different from each other, a heat exchange efficiency in the outdoor heat exchanger may be improved. In particular, at least three headers may be provided in the outdoor heat exchanger to easily vary a number of refrigerant paths when the cooling operation or the heating operation is performed.

When the outdoor device for an air conditioner performs the cooling operation, the number of paths of the refrigerant introduced into the outdoor heat exchanger may decrease, and each of the paths through which the refrigerant passing through the three headers may increase to increase a flow speed of refrigerant, thereby reducing condensation pressure and improving condensation efficiency. When the outdoor device for an air conditioner performs the heating operation, the number of paths through which the refrigerant is introduced into the outdoor heat exchanger may increase, and each of the paths may decrease in length, reducing loss in pressure of the refrigerant, thereby preventing the evaporation pressure from being reduced and improving evaporation efficiency.

Further, as it is not necessary to provide a separate variable path and valve device or valve, which are described with respect to the related art, manufacturing costs of the outdoor heat exchanger may be reduced. Furthermore, as the blower fan that blows the external air is provided above the outdoor heat exchanger so that a flow rate of air passing through an upper side of the outdoor heat exchanger is greater than a flow rate of air passing through a lower side of the outdoor heat exchanger, a flow amount (or heat exchange amount) of refrigerant at the upper side of the outdoor heat exchanger may be greater than a flow amount of refrigerant at the lower side of the outdoor heat exchanger, improving heat exchange efficiency. In particular, to increase the heat exchange amount at the upper side, refrigerant may be branched into a first distribution tube of first and second heat exchangers and a second distribution tube of third heat exchanger through a first branch, and refrigerant may be branched again into the first heat exchanger and the second heat exchanger through a second branch.

Also, a valve may be provide in each of the first and second distribution tubes to easily adjust an amount of refrigerant flowing through the upper and lower sides of the outdoor heat exchanger. A refrigerant distribution structure of the outdoor heat exchanger may be provided as a multi distribution structure, that is, may include the first and second distributors to increase the number of flow paths of the refrigerant. The capillary tube connected to the first or second distributor may be adjusted in length to easily adjust a distribution amount of refrigerant.

Embodiments disclosed herein provide an outdoor device for an air conditioner including an outdoor heat exchanger having improved heat-exchange efficiency.

Embodiments disclosed herein provide an outdoor device for an air conditioner that may include a compressor; a flow switching part or switch disposed or provided at an outlet-side of the compressor to switch a flow direction of a refrigerant according to a cooling or heating operation; and an outdoor heat exchanger connected to the flow switching part. The outdoor heat exchanger may include first to third heat exchange parts or heat exchangers, each of which may include a refrigerant tube through which the refrigerant may flow, the first to third heat exchange parts being connected to each other in parallel during a heating operation and in series during a cooling operation; a first branch part or branch that branches the refrigerant into a first distribution tube, which may be directed to the first and second heat exchange parts, and a second distribution tube, which may be directed to the third heat exchange part; a second branch part or branch that branches the refrigerant branched from the first branch part into a first branch tube, which may be directed to the first heat exchange part, and a second branch tube, which may be directed to the second heat exchange part; and a first valve device or valve disposed or provided in the first distribution tube. When the heating operation is performed, the first valve device may be opened to allow the refrigerant passing through the first branch part to flow into the second distribution tube and the rest or remaining refrigerant to pass through the first valve device so that the refrigerant may be introduced into the first and second branch tubes, and when the cooling operation is performed, the first valve device may be closed to allow the refrigerant passing through the first heat exchange part to be introduced from the first branch tube to the second branch tube and to flow into third heat exchange part via the second heat exchange part.

The outdoor device for an air conditioner may further include a blower fan disposed or provided above the outdoor heat exchanger to blow external air. The first heat exchange part may be disposed or provided at an upper portion of the outdoor heat exchange part, the second heat exchange part may be disposed or provided at a central portion of the outdoor heat exchanger, and the third heat exchange part may be disposed or provided at a lower portion of the outdoor heat exchange part.

A number of refrigerant passages provided in the first or second heat exchange parts may be greater than that of passages provided in the third heat exchange part. The number of refrigerant passage provided in the first heat exchange part may be greater than that of passages provided in the second heat exchange part.

The refrigerant flowing through the first branch tube, the refrigerant flowing through the second branch tube, or the refrigerant flowing through the second distribution tube may be distributed in multi-stages and introduced into the first to third heat exchange parts. The outdoor device for an air conditioner may further include a first distributor disposed or provided on the first branch tube to branch a refrigerant passage; a second distributor disposed or provided on an outlet-side of the first distributor to branch each of the branched refrigerant passages again; and a first capillary disposed or provided on an outlet-side of the second distributor to guide the refrigerant passing through the second distributor to the first heat exchange part.

The outdoor device for an air conditioner may further include a second distributor disposed or provided on the second branch tube to branch a refrigerant passage; a fourth distributor disposed or provided on an outlet-side of the second distributor to branch each of the refrigerant passages branched in the second distributor again; and a second capillary disposed or provided on an outlet-side of the fourth distributor to guide the refrigerant passing through the fourth distributor to the second heat exchange part. The outdoor device for an air conditioner may further include a fifth distributor disposed or provided on the second distribution tube to branch a refrigerant passage; a sixth distributor disposed or provided on an outlet-side of the fifth distributor to branch each of the refrigerant passages branched in the fifth distributor again; and a third capillary disposed or provided on an outlet-side of the sixth distributor to guide the refrigerant passing through the sixth distributor to the third heat exchange part.

The outdoor device for an air conditioner may further include a second valve device or valve disposed or provided in the second distribution tube. The first or second valve device may include an electronic expansion valve which is adjustable in opening degree. The outdoor device for an air conditioner may further include a first header disposed or provided on the first heat exchange part; a second header disposed or provided in the second heat exchange part, the second header being spaced apart from the first header; and a third header disposed or provided in the third heat exchange part, the third header being spaced apart from the second header.

When the first to third heat exchange parts are connected in parallel to each other during the heating operation, the refrigerant introduced into the third heat exchange part may be discharged from the third header and introduced into the second header, the refrigerant introduced into the second heat exchange part may be discharged from the second header and introduced into the first header, and the refrigerant within the first header may be discharged from the outdoor heat exchanger. When the first to third heat exchange parts are connected in series to each other during the heating operation, the refrigerant introduced into the first heat exchange part through the first header may be introduced into the second heat exchange part via the first and second branch tubes, the refrigerant introduced into the second heat exchange part may be discharged from the second header and introduced into the third heat exchange part through the third header, and the refrigerant of the third heat exchange part may be discharged from the outdoor heat exchanger through the second distribution tube.

The outdoor device for an air conditioner may further include a first connection tube that connects the first header to the second header and in which a check valve may be disposed or provided, and a second connection tube that connects the second header to the third header. The check valve may restrict a flow of the refrigerant from the first header to the second header.

The outdoor device for an air conditioner may further include a first coupling plate that supports one or a first side of the refrigerant tube disposed or provided in each of the first and third heat exchange parts, and a second coupling plate that supports the other or a second side of the refrigerant tube. Each of the first to third headers may extend in one direction corresponding to a longitudinal direction of the second coupling plate and be connected to the second coupling plate.

Embodiments disclosed herein further provide an outdoor device for an air conditioner that may include a compressor; a flow switching part or switch disposed or provided at an outlet-side of the compressor to switch a flow direction of a refrigerant according to a cooling or heating operation; an outdoor heat exchanger connected to the flow switching part; and a blower fan disposed or provided above the outdoor heat exchanger. The outdoor heat exchanger may include first to third heat exchange parts or heat exchangers, each of which may include a refrigerant tube, through which the refrigerant may flow, the first to third heat exchange parts being connected to each other in parallel during a heating operation and in series during a cooling operation; a first branch part or branch that branches the refrigerant into a first distribution tube, which may be directed to the first and second heat exchange parts, and a second distribution tube, which may be directed to the third heat exchange part; and a second branch part or branch that branches the refrigerant branched from the first branch part into a first branch tube, which may be directed to the first heat exchange part, and a second branch tube, which may be directed to the second heat exchange part. The first heat exchange part may be disposed or provided at an upper portion of the outdoor heat exchange part, the second heat exchange part may be disposed or provided under the first heat exchange part, and the third heat exchange part may be disposed or provided under the second heat exchange part.

The outdoor device for an air conditioner may further include a first valve device or valve disposed or provided in the first distribution tube, and a second valve device disposed or provided in the second distribution tube. When the heating operation is performed, the first and second valve devices may be opened to allow the refrigerant passing through the first branch part to flow into the second distribution tube and the rest or remaining refrigerant to pass through the first valve device so that the refrigerant may be introduced into the first and second branch tubes, and when the cooling operation is performed, the first valve device may be closed, and the second valve device may be opened to allow the refrigerant passing through the first heat exchange part to be introduced from the first branch tube to the second branch tube and to flow into third heat exchange part via the second heat exchange part.

The outdoor device for an air conditioner may further include a capillary tube disposed or provided on one or a first side of the first to third heat exchange parts, and a header disposed or provided on the other side of the first to third heat exchange parts. When the heating operation is performed, the refrigerant may be introduced into the first to third heat exchange parts through the capillary tube and discharged from the first to third heat exchange parts through the header.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor device for an air conditioner, comprising:

a compressor;

a flow switch provided at an outlet-side of the compressor to switch a flow direction of a refrigerant based on a cooling operation or a heating operation; and an outdoor heat exchanger connected to the flow switch, wherein the outdoor heat exchanger includes:

first to third heat exchangers, each of which includes a refrigerant tube through which the refrigerant flows, wherein the first to third heat exchangers are connected to each other in parallel during a heating operation and in series during a cooling operation;

a plurality of headers including a first header provided at the first heat exchanger, a second header provided at the second heat exchanger, and a third header provided at the third heat exchanger;

a first branch that branches the refrigerant into a first distribution tube, which is directed to the first and second heat exchangers, and a second distribution tube, which is directed to the third heat exchanger;

a second branch that branches the refrigerant branched from the first branch into a first branch tube, which is directed to the first heat exchanger, and a second branch tube, which is directed to the second heat exchanger; and a first valve provided in the first distribution tube, wherein, when the heating operation is performed, the first valve is opened to allow the refrigerant passing through the first branch to flow through the first valve to be introduced into the first and second branch tubes, and when the cooling operation is performed, the first valve is closed to allow the refrigerant introduced into the first heat exchanger through the first header to be introduced into the second heat exchanger via the first and second branch tubes, the refrigerant introduced into the second heat exchanger to be discharged from the second header and introduced into the third heat exchanger through the third header, and the refrigerant of the third heat exchanger to be discharged from the outdoor heat exchanger through the second distribution tube.

2. The outdoor device according to claim 1, further including a blower fan provided above the outdoor heat exchanger to blow external air, wherein the first heat exchanger is provided at an upper portion of the outdoor heat exchanger, the second heat exchanger is provided at a central portion of the outdoor heat exchanger, and the third heat exchanger is provided at a lower portion of the outdoor heat exchanger.

3. The outdoor device according to claim 2, wherein a number of refrigerant passages provided in the first heat exchanger or second heat exchanger is greater than a number of passages provided in the third heat exchanger.

4. The outdoor device according to claim 3, wherein the number of refrigerant passage provided in the first heat exchanger is greater than the number of passages provided in the second heat exchanger.

5. The outdoor device according to claim 1, wherein the refrigerant flowing through the first branch tube, the refrigerant flowing through the second branch tube, and the refrigerant flowing through the second distribution tube is distributed in multi-stages and introduced into the first to third heat exchangers.

6. The outdoor device according to claim 5, further including:

a first distributor provided on the first branch tube to branch a refrigerant passage;

at least one second distributor provided on an outlet-side of the first distributor to branch each of the refrigerant passages branched in the first distributor again; and a plurality of capillary provided on an outlet-side of the at least one second distributor to guide the refrigerant passing through the second distributor to the first heat exchanger.

7. The outdoor device according to claim 5, further including:

a first distributor provided on the second branch tube to branch a refrigerant passage;

at least one second distributor provided on an outlet-side of the first distributor to branch each of the refrigerant passages branched in the first distributor again; and a plurality of capillary provided on an outlet-side of the second distributor to guide the refrigerant passing through the second distributor to the second heat exchanger.

8. The outdoor device according to claim 5, further including:

a first distributor provided on the second distribution tube to branch a refrigerant passage;

a second distributor provided on an outlet-side of the first distributor to branch each of the refrigerant passages branched in the first distributor again; and a plurality of capillary provided on an outlet-side of the second distributor to guide the refrigerant passing through the second distributor to the third heat exchanger.

9. The outdoor device according to claim 1, further including a second valve provided in the second distribution tube, wherein the first valve or the second valve includes an electronic expansion valve which is adjustable in opening degree.

10. The outdoor device according to claim 1, wherein the second header is spaced apart from the first header, and the third header is spaced apart from the second header.

11. The outdoor device according to claim 10, wherein, when the first to third heat exchangers are connected in parallel to each other during the heating operation, the refrigerant introduced into the third heat exchanger is discharged from the third header and introduced into the second header, the refrigerant introduced into the second heat exchanger is discharged from the second header and introduced into the first header, and the refrigerant within the first header is discharged from the outdoor heat exchanger.

12. The outdoor device according to claim 10, further including:

a first connection tube that connects the first header to the second header and in which a check valve is provided; and a second connection tube that connects the second header to the third header, wherein the check valve restricts a flow of the refrigerant from the first header to the second header.

13. The outdoor device according to claim 1, further including:

a first coupling plate that supports a first side of the refrigerant tube provided in each of the first and third heat exchangers; and a second coupling plate that supports a second side of the refrigerant tube.

14. The outdoor device according to claim 13, wherein each of the first to third headers extends in a direction corresponding to a longitudinal direction of the second coupling plate and is connected to the second coupling plate.

15. An air conditioner including the outdoor device of claim 1.

16. An outdoor device for an air conditioner, comprising:

a compressor;

a flow switch provided at an outlet-side of the compressor to switch a flow direction of a refrigerant based on a cooling or heating operation;

an outdoor heat exchanger connected to the flow switch; and a blower fan provided above the outdoor heat exchanger, wherein the outdoor heat exchanger includes:

first to third heat exchangers, each of which includes a refrigerant tube through which the refrigerant flows, wherein the first to third heat exchangers are connected to each other in parallel during a heating operation and in series during a cooling operation;

a first branch that branches the refrigerant into a first distribution tube, which is directed to the first and second heat exchangers, and a second distribution tube, which is directed to the third heat exchanger;

a second branch that branches the refrigerant branched from the first branch into a first branch tube, which is directed to the first heat exchanger, and a second branch tube, which is directed to the second heat exchanger, wherein the first heat exchanger is provided at an upper portion of the outdoor heat exchanger, the second heat exchanger is provided under the first heat exchanger, and the third heat exchanger is provided under the second heat exchanger;

a first valve provided in the first distribution tube; and a second valve provided in the second distribution tube, wherein, when the heating operation is performed, the first and second valves are opened to allow the refrigerant passing through the first branch to flow through the first valve to be introduced into the first and second branch tubes, and when the cooling operation is performed, the first valve is dosed, and the second valve is opened to allow the refrigerant passing through the first heat exchanger to be introduced from the first branch tube to the second branch tube and to flow into third heat exchanger via the second heat exchanger.

17. The outdoor device according to claim 16, further including:

a plurality of capillary tubes provided on a first side of the first to third heat exchangers; and a header provided on a second side of the first to third heat exchangers, wherein, when the heating operation is performed, the refrigerant is introduced into the first to third heat exchangers through the plurality of capillary tubes and discharged from the first to third heat exchangers through the header.

18. An air conditioner including the outdoor device of claim 16.

* * * * *